US006299155B1

(12) United States Patent
Fujii et al.

(10) Patent No.: US 6,299,155 B1
(45) Date of Patent: Oct. 9, 2001

(54) METHOD OF AND APPARATUS FOR FEEDING SHEETS

(75) Inventors: Tadashi Fujii, Hadano; Yuzuru Ootsuka, Minamiashigara, both of (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/274,965

(22) Filed: Mar. 23, 1999

(30) Foreign Application Priority Data

Mar. 23, 1998 (JP) ..... 10-073990
Mar. 27, 1998 (JP) ..... 10-082020

(51) Int. Cl.[7] ..... B65H 3/08
(52) U.S. Cl. ..... 271/108
(58) Field of Search ..... 271/108, 90, 91, 271/92, 93, 94, 95, 96, 97, 98, 99, 100, 101, 102, 103, 104, 105, 106, 107; 294/64.1; 414/752.1; 248/206.2

(56) References Cited

U.S. PATENT DOCUMENTS 2,910,264 * 10/1959 Lindenberger ..... 248/206.2
3,514,065 * 5/1970 Litt et al. ..... 242/206.2
3,999,795 * 12/1976 Barker ..... 271/108
4,763,941 * 8/1988 Sniderman ..... 271/103
5,076,564 * 12/1991 Marass ..... 271/108
5,087,025 * 2/1992 Hamada ..... 271/90
5,190,332 * 3/1993 Nagai et al. ..... 271/90
5,377,967 * 1/1995 Eberle ..... 271/90
5,451,086 * 9/1995 Pazzaglia ..... 271/108
5,657,981 * 8/1997 Kelly et al. ..... 271/108
5,685,534 * 11/1997 Zeltner ..... 271/108
5,882,055 * 3/1999 Smith ..... 294/64.1
6,024,392 * 2/2000 Blatt ..... 294/64.1

* cited by examiner

*Primary Examiner*—John M. Jillions
(74) *Attorney, Agent, or Firm*—Sughrue, Mion, Zinn, Macpeak & Seas, PLLC

(57) ABSTRACT

An apparatus for feeding a sheet has a pair of suction cups movable into and out of a cassette, a displacing mechanism for displacing the suction cups between a position in the cassette and a sheet delivering mechanism to cause the suction cups to transfer a stimulable phosphor sheet from the cassette to the sheet delivering mechanism, and a piping system connecting the suction cups to a vacuum pump for attracting the stimulable phosphor sheet to the suction cups, and for ejecting air from the suction cups toward a surface to be attracted of the stimulable phosphor sheet when the suction cups are moved into the cassette. The stimulable phosphor sheet can smoothly and reliably be removed from the cassette while the suction cups are effectively prevented from being deformed.

20 Claims, 15 Drawing Sheets

METHOD OF AND APPARATUS FOR FEEDING SHEETS

BACKGROUND OF THE INVENTION

Field of the Invention

The present invention relates to a method of and apparatus for feeding a sheet such as a photographic film, a stimulable phosphor sheet, etc., by smoothly and reliably attracting the sheet with suction cups.

There is known a system for recording radiation image information of a subject such as a human body with a stimulable phosphor, and reproducing the recorded radiation image information on a photosensitive medium such as a photographic film, or displaying the recorded radiation image information on a display device such as a CRT or the like.

The stimulable phosphor is a phosphor which, when exposed to an applied radiation, stores a part of the energy of the radiation, and, when subsequently exposed to applied stimulating rays such as visible light, emits light in proportion to the stored energy of the radiation. Usually, a sheet provided with a layer of the stimulable phosphor, or a stimulable phosphor sheet, is stored in a cassette, or a plurality of such stimulable phosphor sheets are stored in a magazine.

The above known system includes an image information reading apparatus which comprises a reading section for reading image information recorded on a stimulable phosphor sheet, and an erasing section for erasing remaining image information from the stimulable phosphor sheet after the recorded image information has been read. In the image information reading apparatus, after a cassette or a magazine (hereinafter referred to as a "cassettes") housing a stimulable phosphor sheet which bears radiation image information of a subject recorded by an external exposure device is inserted into a loading section, the lid of the cassette is opened, and then the stimulable phosphor sheet is taken out of the cassette by a sheet feeding mechanism.

The stimulable phosphor sheet is thereafter delivered to the reading section by a sheet delivering mechanism. In the reading section, a laser beam or the like is applied to the stimulable phosphor sheet to read the recorded image information from the stimulable phosphor sheet. Thereafter, remaining image information is erased from the stimulable phosphor sheet in the erasing section, after which the stimulable phosphor sheet is stored in the cassette from which it has been removed or another cassette in the loading section. The cassette which stores the stimulable phosphor sheet is then removed from the image information reading apparatus.

The loading section does not have a space large enough to allow the cassette to be fully opened because of limitations imposed by the small size of the image information reading apparatus. In the loading section, therefore, the cassette is opened by tilting the lid of the cassette through a predetermined angle. The sheet feeding mechanism moves suction cups along a path which is inclined obliquely downwardly toward the stimulable phosphor sheet in the cassette, causes the suction cups to attract the stimulable phosphor sheet, and then lifts the suction cups to remove the stimulable phosphor sheet from the cassette.

FIG. 21 of the accompanying drawings shows a suction cup 2 as it moves into a cassette which stores a sheet 3. As shown in FIG. 21, when the suction cup 2 moves obliquely downwardly to a surface to be attracted to the sheet 3 as indicated by the arrow X, the leading edge of a skirt 4 of the suction cup 2 obliquely contacts the surface of the sheet 3. Therefore, until the attraction by the suction cup 2 of the sheet 3 is completed, the skirt 4 slips against the surface of the sheet 3. At this time, frictional resistance imposed on the skirt 4 by the sheet 3 tends to deform, e.g., roll, the leading edge of the skirt 4, resulting in a failure to attract the sheet 3 with the suction cup 2.

The above problem is not limited to the arrangement in which the suction cups move obliquely toward and away from the stimulable phosphor sheet. If the suction cups have skirts whose height is larger than the diameter of the suction cups, then the skirts tend to roll on the stimulable phosphor sheet even when the suction cups move perpendicularly toward and away from the stimulable phosphor sheet.

The above system also includes an image information reproducing apparatus for reproducing radiation image information recorded on a stimulable phosphor sheet on a photosensitive medium such as a photographic film. The image information reproducing apparatus has a magazine loading section for loading a magazine which stores a plurality of photosensitive mediums, and a sheet feeding mechanism for removing the photosensitive mediums, one by one, from the magazine that is loaded in the magazine loading section. The sheet feeding mechanism has suction cups which suffer the same problem with respect to the photosensitive mediums as the problem described above with respect to the suction cups and the stimulable phosphor sheets in the image information reading apparatus.

Attempts have heretofore been made to solve the above problem by making suction cups of a slippery material or roughening the attracting surfaces of suction cups to make them slippery. However, if the suction cups are made slippery, then the frictional resistance between the suction cups and the sheet becomes smaller than required. Specifically, when the slippery suction cups move while attracting the sheet, the sheet is liable to be positionally displaced relatively to the suction cups, or fall off the suction cups.

SUMMARY OF THE INVENTION

It is a major object of the present invention to provide a method of and an apparatus for feeding a sheet by smoothly and reliably attracting the sheet with suction cups while effectively preventing the suction cups from being deformed, with a relatively simple arrangement.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
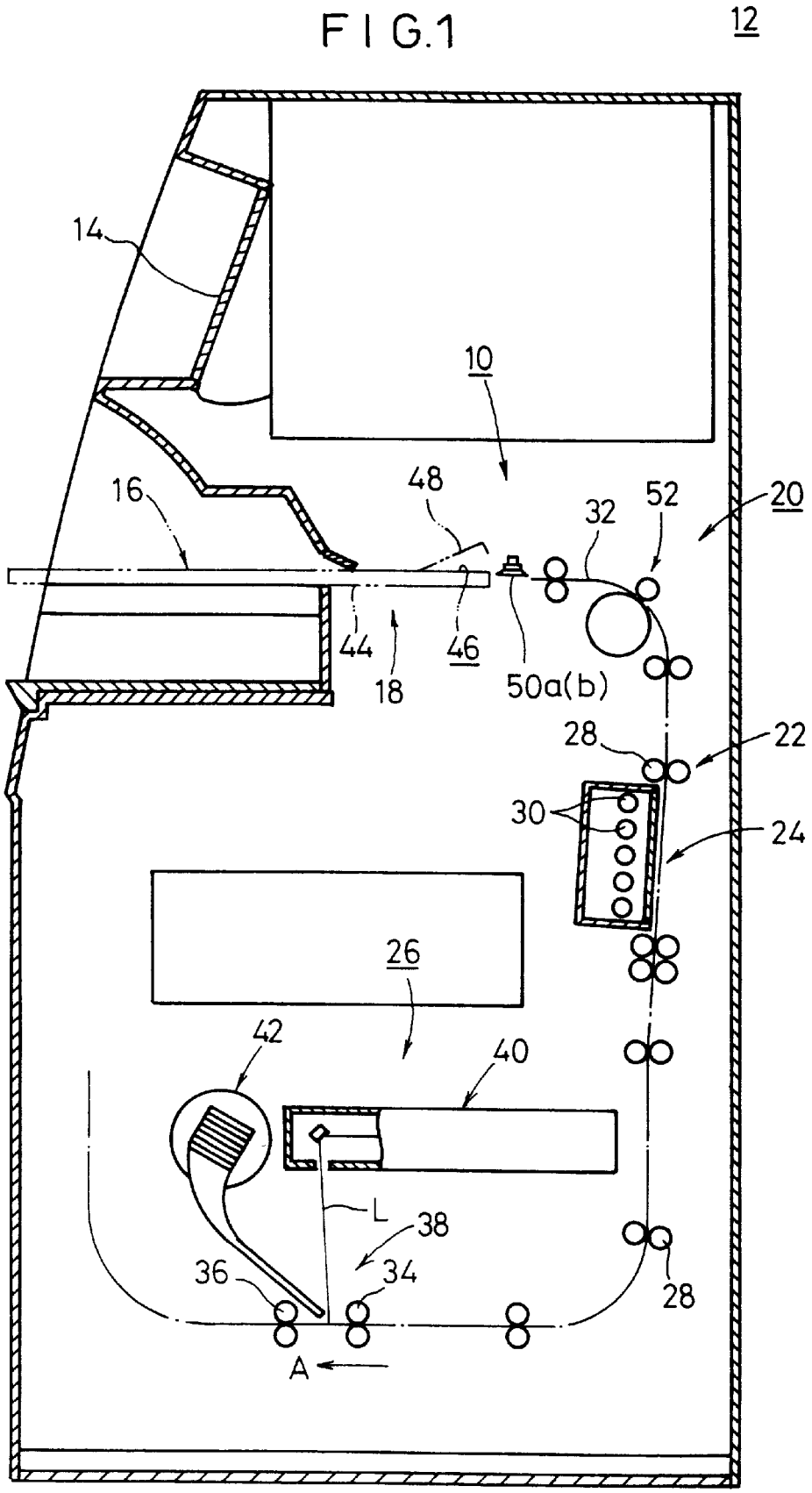
FIG. 1 is a vertical cross-sectional view of an image information reading apparatus which incorporates therein a sheet feeding mechanism according to a first embodiment of the present invention.

As shown in FIG. 1, an image information reading apparatus 12 has a touch panel 14 on an upper front face thereof which serves as a control console and a monitor. The image information reading apparatus 12 also has a cassette loading section 18 disposed below the touch panel 14 for loading a cassette 16 removably in a sheet removal position. The cassette loading section 18 includes a sheet feeder 20 having a sheet feeding mechanism 10 according to a first embodiment of the present invention. The image information reading apparatus 12 further includes an erasing section 24 and a reading section 26 which are connected to the sheet feeder 20 through a sheet delivery system 22.

The sheet delivery system 22 has a plurality of pairs of nip rollers 28 spaced along a vertical delivery path. The erasing section 24 has a plurality of erasing light sources 30 disposed in a position on one side of the vertical delivery path.

The reading section 26 comprises an auxiliary scanning system 38 having first and second pairs of rollers 34, 36 for delivering a stimulable phosphor sheet 32 from the cassette 16 in an auxiliary scanning direction indicated by the arrow A, an optical system 40 for applying a laser beam L as it is deflected in a main scanning direction (substantially perpendicular to the auxiliary scanning direction) to the stimulable phosphor sheet 32 as it is delivered in the auxiliary scanning direction, and a light guiding system 42 for photoelectrically reading light which is emitted from the stimulable phosphor sheet 32 upon exposure to the laser beam L.

The cassette 16 comprises a housing 44 for storing the stimulable phosphor sheet 32 therein, and a lid 48 mounted on the housing 44 for opening and closing an opening 46 defined in the housing 44. The cassette loading section 18 has a lid opening/closing mechanism (not shown) for opening and closing the lid 48.

Figure 2:
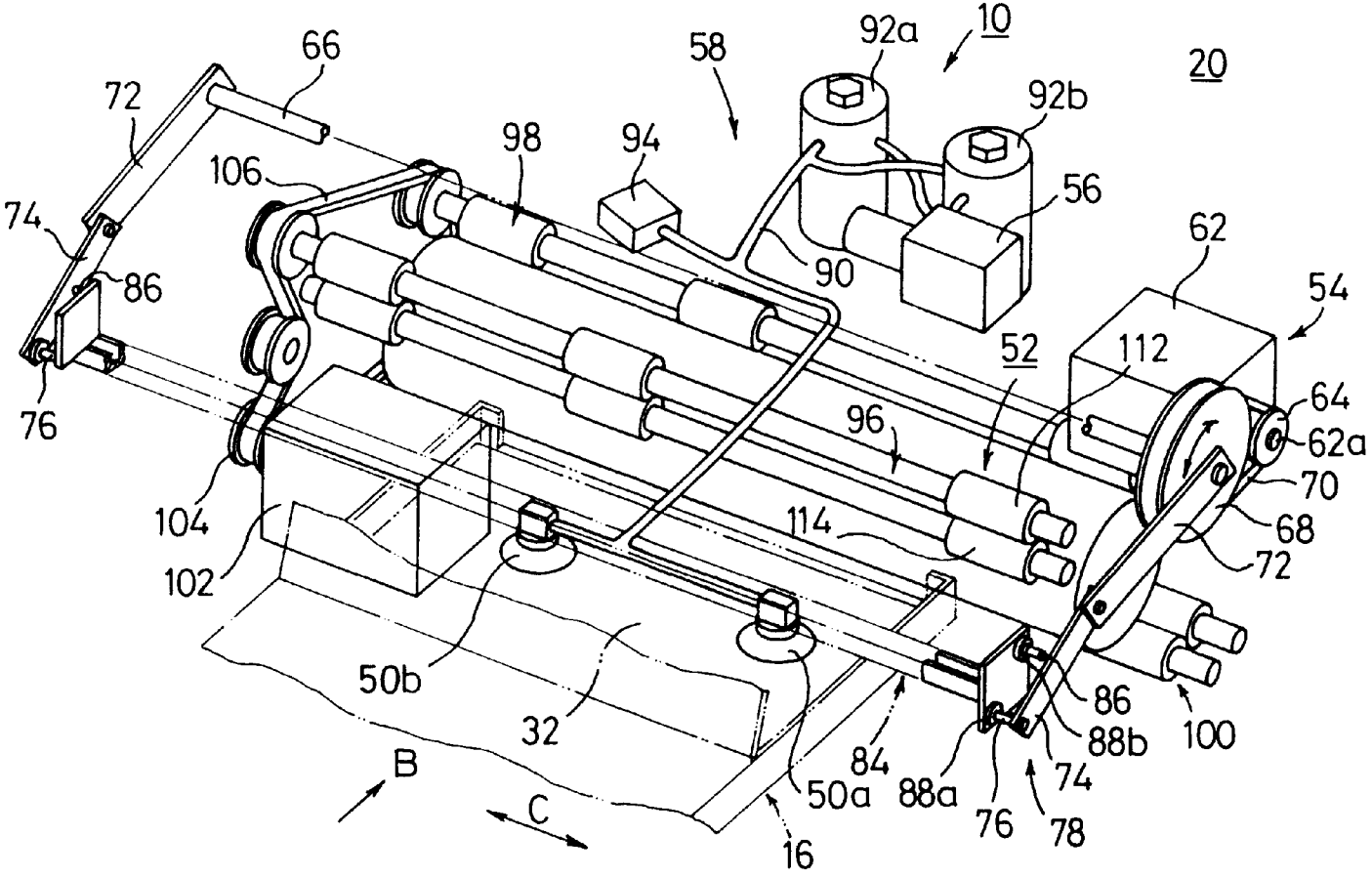
FIG. 2 is a perspective view of the sheet feeding mechanism according to the first embodiment.
Figure 3:
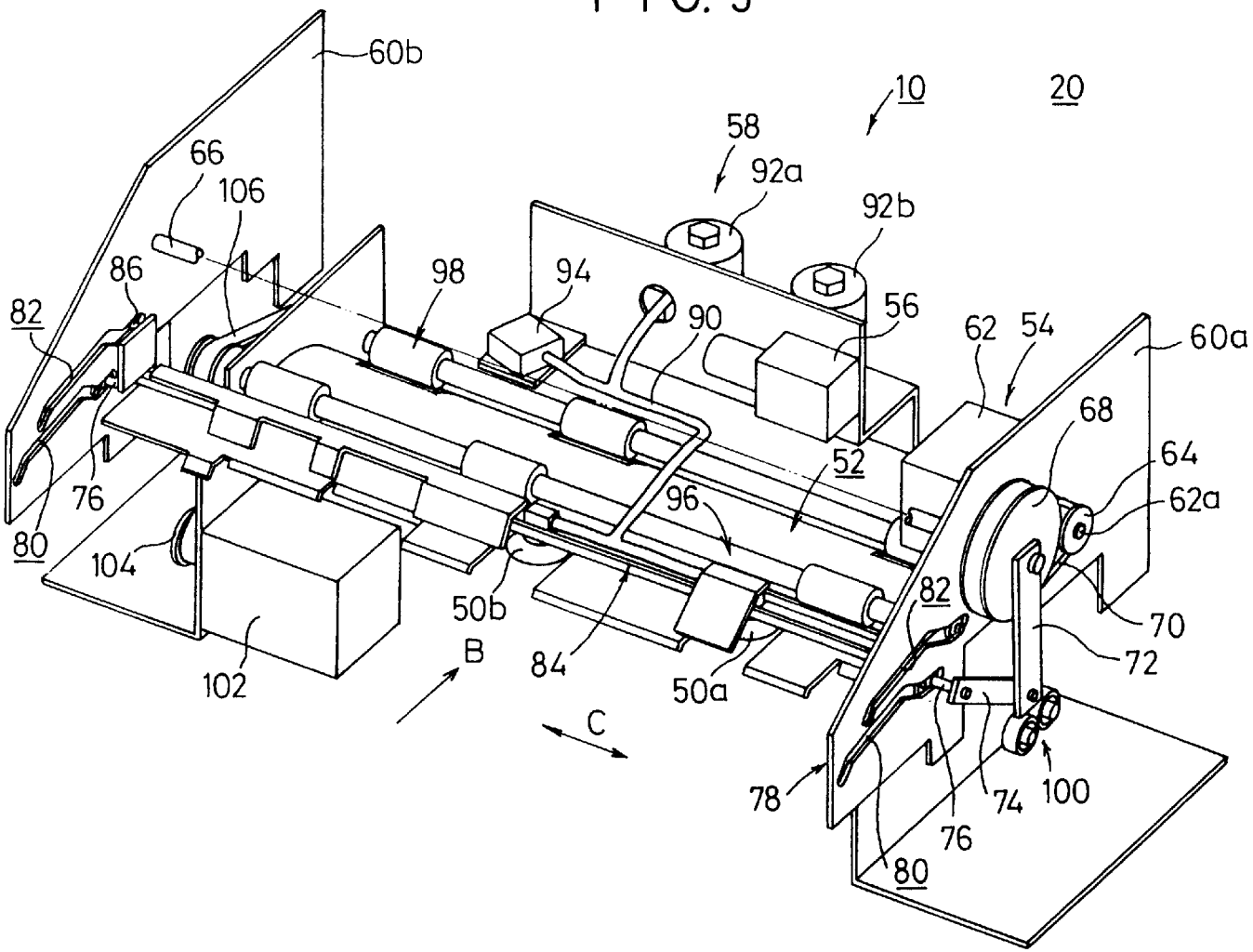
FIG. 3 is a perspective view of a sheet feeder, which includes the sheet feeding mechanism, of the image information reading apparatus shown in FIG. 1.

As shown in FIGS. 2 and 3, the sheet feeding mechanism 10 comprises a pair of suction cups 50*a*, 50*b* movable into the cassette 16 in the cassette loading section 18 with the lid 48 being open, a displacing mechanism 54 for displacing the suction cups 50*a*, 50*b* between the cassette 16 and a sheet delivering mechanism 52 and bringing the stimulable phosphor sheet 32 in the cassette 16 to the sheet delivering mechanism 52, and a piping system 58 connecting the suction cups 50*a*, 50*b* to a vacuum pump (vacuum source) 56 for causing the suction cups 50*a*, 50*b* to attract the stimulable phosphor sheet 32 in the cassette 16, and for ejecting air from the suction cups 50*a*, 50*b* toward a surface to be attracted, which is the reverse surface of the sheet opposite to a recording surface, of the stimulable phosphor sheet 32 when the suction cups 50*a*, 50*b* are moved into the cassette 16.

The sheet feeder 20 has a pair of vertical side plates 60*a*, 60*b* which are spaced apart from each other in the direction indicated by the arrow C that is transverse to the direction indicated by the arrow B in which the stimulable phosphor sheet 32 is removed from the cassette 16 by the suction cups 50*a*, 50*b*. The displacing mechanism 54 has a first motor 62 fixedly mounted on the side plate 60*a* and having a drive shaft 62*a*, a small-diameter pulley 64 attached to the drive shaft 62*a*, a large-diameter pulley 68 attached to an end of a drive shaft 66, and an endless belt 70 trained around the small-diameter pulley 64 and the large-diameter pulley 68.

Figure 4:
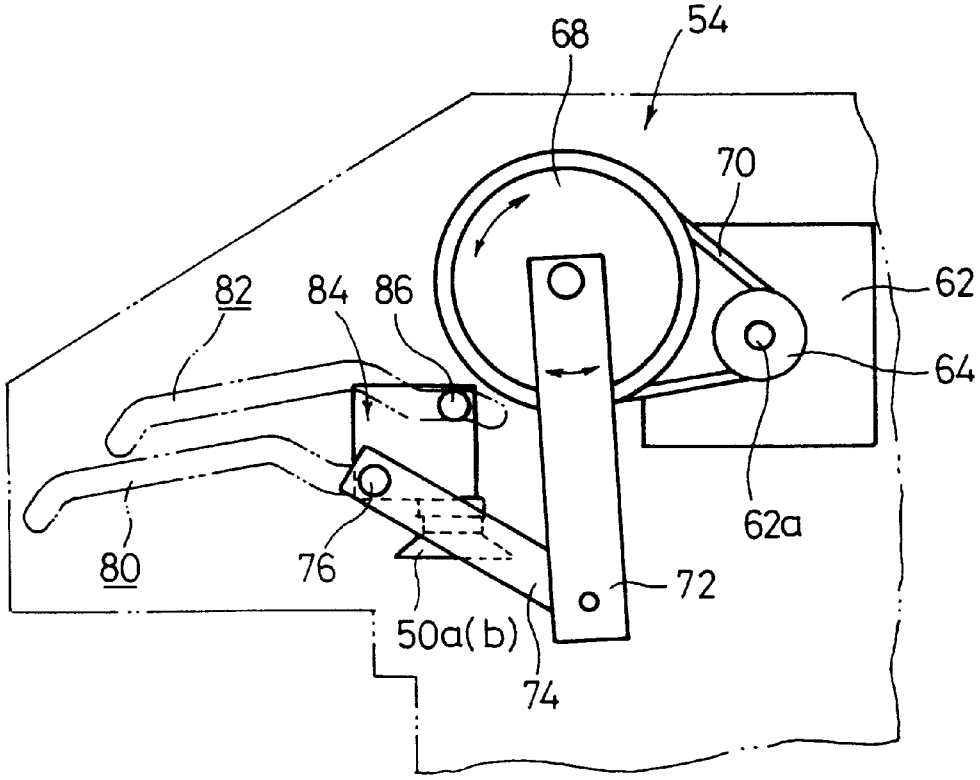
FIG. 4 is a side elevational view of the sheet feeding mechanism shown in FIG. 2.

The drive shaft 66 has opposite ends rotatably supported respectively by the side plates 60*a*, 60*b*. An arm 72 has an end fixed to the large-diameter pulley 68 and an opposite end to which an end of a link 74 is angularly movably coupled, as shown in FIGS. 2 through 4. The link 74 has an opposite end coupled to a first support shaft 76. To the other end of the drive shaft 66, there is fixed an end of another arm 72 whose opposite end is angularly movably coupled to an end of another link 74. The other link 74 has an opposite end coupled to another first support shaft 76.

Each of the side plates 60*a*, 60*b* has a pair of guide grooves 80, 82 defined therein as a guiding means 78 for moving the suction cups 50*a*, 50*b* along a path which is inclined obliquely downwardly toward the surface to be attracted of the stimulable phosphor sheet 32 in the cassette 16. The guide grooves 80, 82 have respective shapes for moving the suction cups 50*a*, 50*b* along the path. On each of the side plates 60*a*, 60*b*, the first support shaft 76 is aligned with the guide groove 80 and fixed to a corner of a rectangular movable frame 84, and a second support shaft 86 is aligned with the guide groove 82 and fixed to a diagonally opposite corner of the rectangular movable frame 84.

Specifically, the first support shaft 76 extends through the guide groove 80 and has opposite ends fixed respectively to the link 74 and the movable frame 84, and the second support shaft 86 extends through the guide groove 82 and has an end fixed to the movable frame 84. The first and second support shafts 76, 86 have respective bearings 88*a*, 88*b* mounted thereon and inserted respectively in the guide grooves 80, 82.

The movable frames 84 on the respective side plates 60*a*, 60*b* support therebetween the suction cups 50*a*, 50*b* which are spaced apart from each other by a distance commensurate with the dimension, in the direction indicated by the arrow C, of a stimulable phosphor sheet 32 having a minimum size. All stimulable phosphor sheets 32 of different sizes which are handled by the sheet feeder 20 are positioned with respect to a reference position near the side plate 60*a*, for example.

Figure 5:
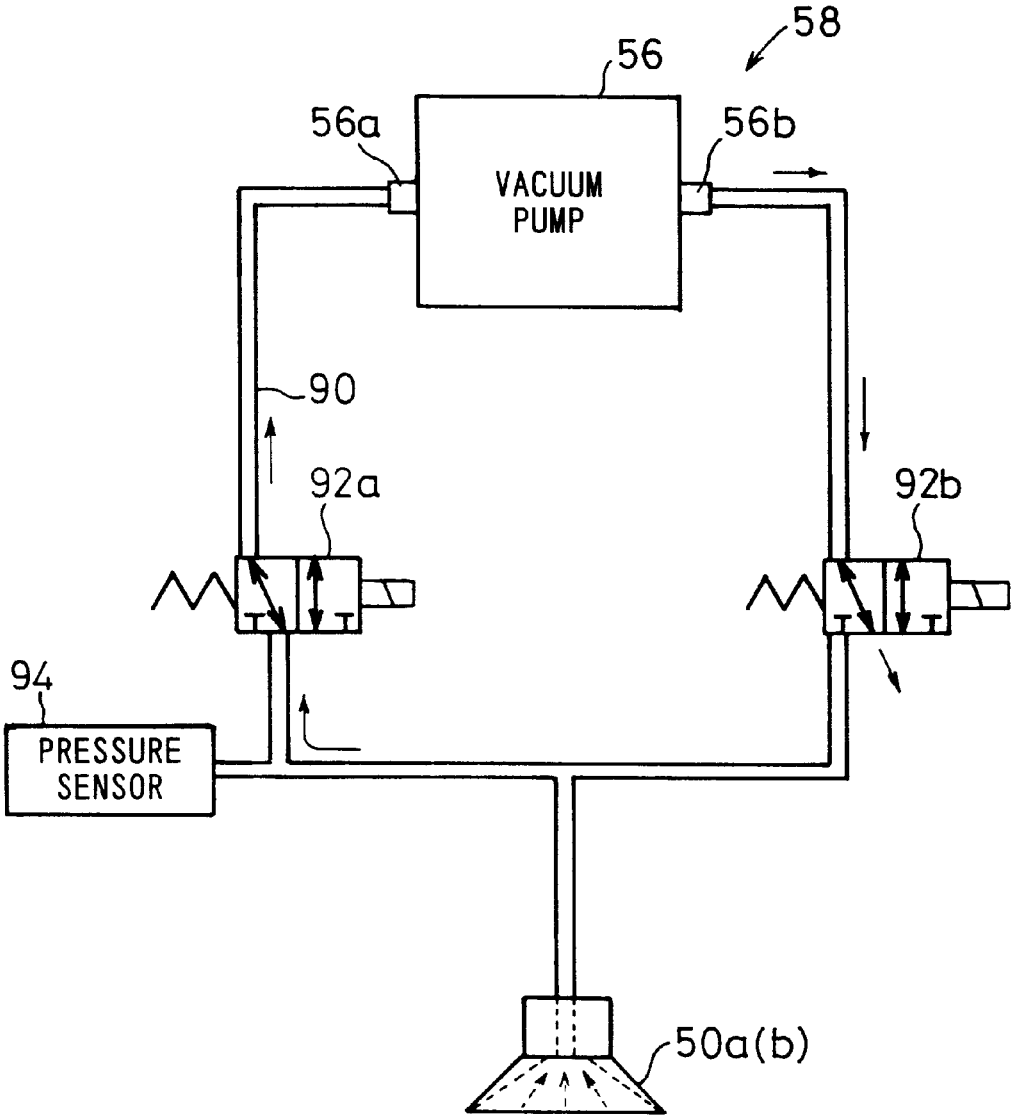
FIG. 5 is a schematic diagram of a piping system of the sheet feeding mechanism shown in FIG. 2.

As shown in FIGS. 2 and 5, the piping system 58 coupled to the suction cups 50*a*, 50*b* has a circulation passage 90 communicating with the suction cups 50*a*, 50*b* and an inlet port 56*a* and an outlet port 56*b* of a vacuum pump 56, and first and second solenoid-operated directional control valves 92*a*, 92*b* connected to the circulation passage 90 for selectively connecting the suction cups 50*a*, 50*b* to the inlet port 56*a* of the vacuum pump 56 to cause the suction cups 50*a*, 50*b* to attract the stimulable phosphor sheet 32, and connecting the suction cups 50*a*, 50*b* to the outlet port 56*b* of the vacuum pump 56 to eject air from the suction cups 50*a*, 50*b* toward the surface to be attracted of the stimulable phosphor sheet 32.

The circulation passage 90 is connected to a pressure sensor (pressure detecting means) 94 connected to the circulation passage 90 somewhere between the suction cups 50*a*, 50*b* and the inlet port 56*a* of the vacuum pump 56, e.g., between the first solenoid-operated directional control valve 92*a* and the suction cups 50*a*, 50*b*, for detecting a negative pressure or vacuum in the suction cups 50*a*, 50*b*. Each of the first and second solenoid-operated directional control valves 92*a*, 92*b* comprises a three-port valve.

Figure 6:
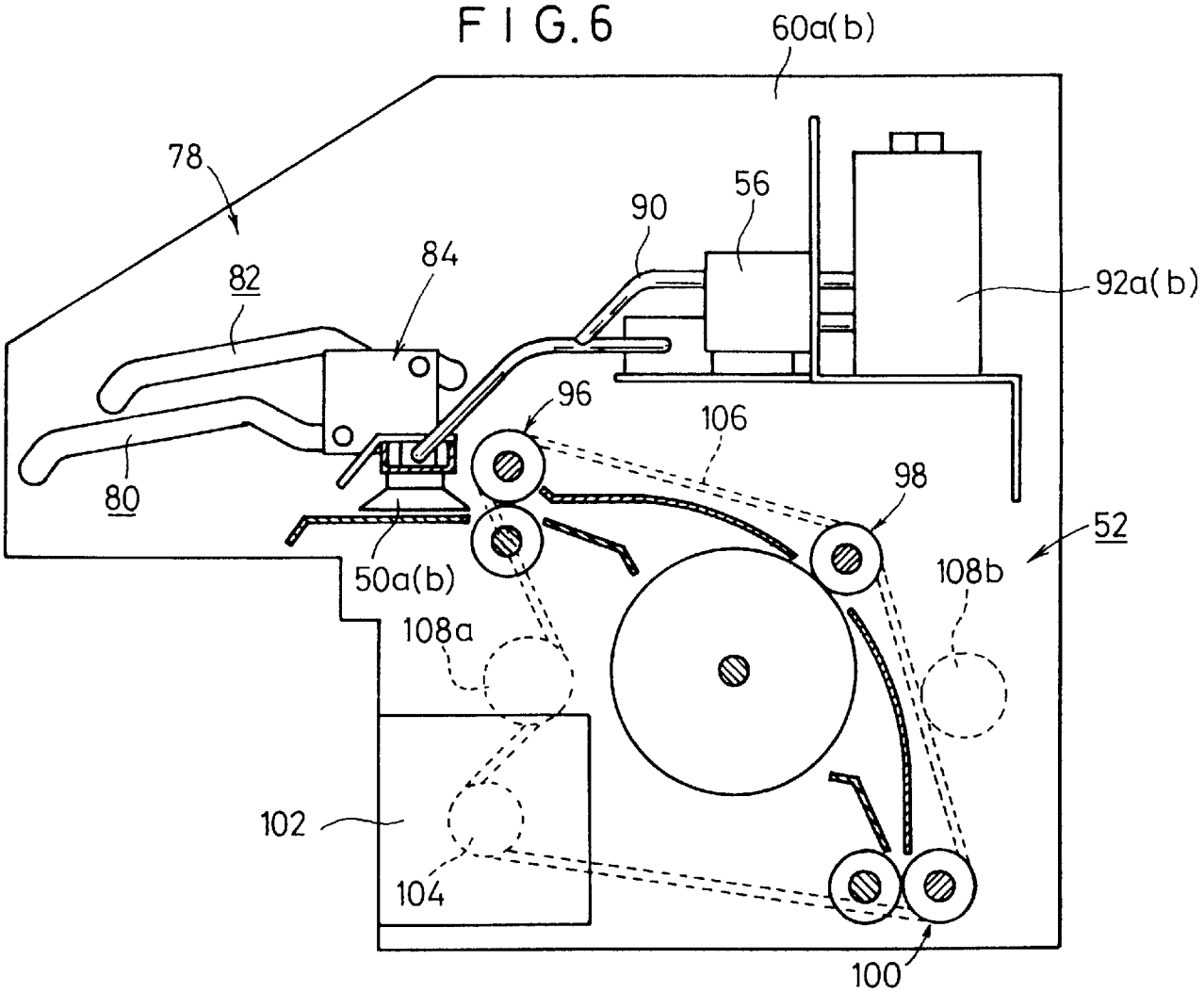
FIG. 6 is a side elevational view of a sheet delivering mechanism of the sheet feeder.

As shown in FIGS. 2, 3, and 6, the sheet delivering mechanism 52 comprises a plurality of sets of nip rollers 96, 98, 100, and a second motor 102 for rotating the nip rollers 96, 98, 100 in unison with each other. The second motor 102 has a drive shaft with a drive pulley 104 fixedly mounted thereon. An endless belt 106 is trained around the drive pulley 104, tension rollers 108*a*, 108*b*, and driven pulleys (not shown) coaxially coupled to selected ones of the nip rollers 96, 98, 100. As shown in FIG. 2, the nip rollers 96 include a plurality of rubber rollers 112, 114 spaced at given intervals and each having a certain width in the direction indicated by the arrow C. The other nip rollers 98, 100 are similar in structure to the nip rollers 96. The nip rollers 98 include a roller having a relatively large diameter for guiding the stimulable phosphor sheet 32 to pass through the sheet delivering mechanism 52.

Operation of the sheet feeding mechanism 10 of the above structure will be described below with respect to a sheet feeding method according to the present invention.

A stimulable phosphor sheet 32 with radiation image information of a subject such as a human body being recorded by an exposure device (not shown) is stored in the cassette 16 in a light-tight fashion, and the cassette 16 is then set in the cassette loading section 18 of the image information reading apparatus 12. After being loaded in the cassette loading section 18, the lid 48 of the cassette 16 is swung to a given angular position by the lid opening/closing mechanism in the cassette loading section 18, opening the opening 46 of the cassette 16.

Then, the displacing mechanism 54 is actuated to displace the suction cups 50*a*, 50*b* into the cassette 16, and the suction cups 50*a*, 50*b* eject air toward the surface to be attracted to the stimulable phosphor sheet 32 stored in the cassette 16. Specifically, the first motor 62 is energized to cause the small-diameter pulley 64 and the endless belt 70 to turn the large-diameter pulley 68 on the side plate 60*a* about its own axis in unison with the drive shaft 66 in one direction.

The arm 72 is fixed to the large-diameter pulley 68 on the side plate 60*a*, and the other arm 72 is fixed to the other large-diameter pulley 68 on the side plate 60*b*. Therefore, when the drive shaft 66 is turned about its own axis, the arms 72 are angularly moved about the drive shaft 66. As described above, the first support shafts 76 are coupled to the distal ends of the arms 72 by the respective links 74, and the first and second support shafts 76, 86 are movably disposed in the respective guide grooves 80, 82 in each of the side plates 60*a*, 60*b* by the respective bearings 88*a*, 88*b*.

Figure 8:
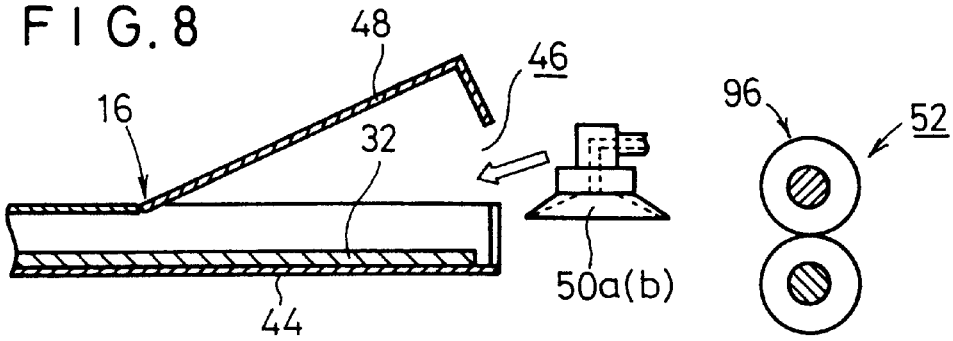
FIG. 8 is a cross-sectional view showing the position of parts to start feeding a stimulable phosphor sheet with suction cups in the sheet feeding mechanism shown in FIG. 2.

When the arms 72 are angularly moved, the first and second support shafts 76, 86 move respectively along the guide grooves 80, 82. The movable frames 84 connected to the first and second support shafts 76, 86 then move the suction cups 50*a*, 50*b* along the path which is inclined obliquely downwardly toward the surface to be attracted of the stimulable phosphor sheet 32 in the cassette 16 (see FIG. 8).

Figure 7:
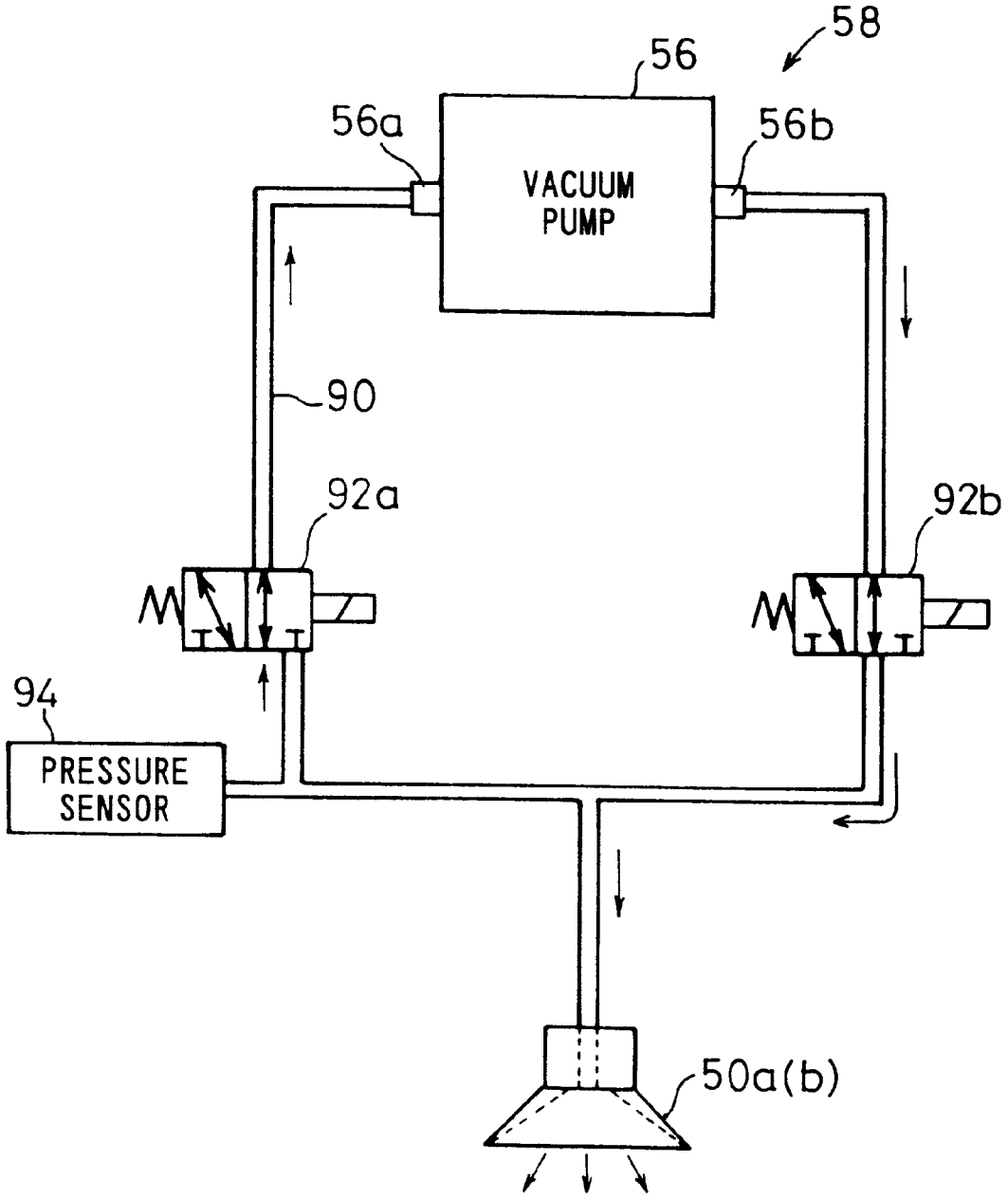
FIG. 7 is a schematic diagram of the piping system which is switched to discharge air from suction cups.

In the piping system 58, as shown in FIG. 7, the first and second solenoid-operated directional control valves 92*a*, 92*b* are actuated to vent the inlet port 56*a* of the vacuum pump 56 to the atmosphere and connect the outlet port 56*b* thereof to the suction cups 50*a*, 50*b*. When the vacuum pump 56 is actuated, the vacuum pump 56 draws ambient air through the inlet port 56*a* and discharges air through the outlet port 56*b*. The air from the outlet port 56*b* is ejected from the suction cups 50*a*, 50*b* toward the stimulable phosphor sheet 32 stored in the cassette 16 (see FIG. 9).

Figure 10:
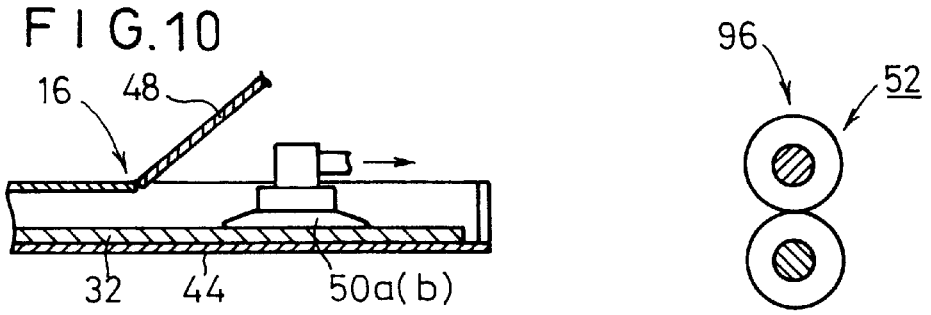
FIG. 10 is a cross-sectional view showing the suction cups as they attract the stimulable phosphor sheet in the sheet feeding mechanism shown in FIG. 2.

When the suction cups 50*a*, 50*b* are guided by the guiding means 78 to a position where they will attract the stimulable phosphor sheet 32, the first and second solenoid-operated directional control valves 92*a*, 92*b* are inactivated, connecting the inlet port 56*a* of the vacuum pump 56 to the suction cups 50*a*, 50*b* and venting the outlet port 56*b* thereof to the atmosphere, as shown in FIG. 5. When the vacuum pump 56 is actuated, the suction cups 50*a*, 50*b* draw in air from between the suction cups 50*a*, 50*b* and the surface to be attracted of the stimulable phosphor sheet 32, as shown in FIG. 10.

Then, the suction cups 50*a*, 50*b* attract the surface of the stimulable phosphor sheet 32. When the pressure sensor 94 detects a predetermined negative pressure or vacuum in the suction cups 50*a*, 50*b*, the first motor 62 is reversed to angularly move the arms 72 to displace the movable frames 84 and the suction cups 50*a*, 50*b* from the cassette 16 toward the sheet delivering mechanism 52. The stimulable phosphor sheet 32 attracted by the suction cups 50*a*, 50*b* is now taken out of the cassette 16 through the opening 46.

Figure 11:
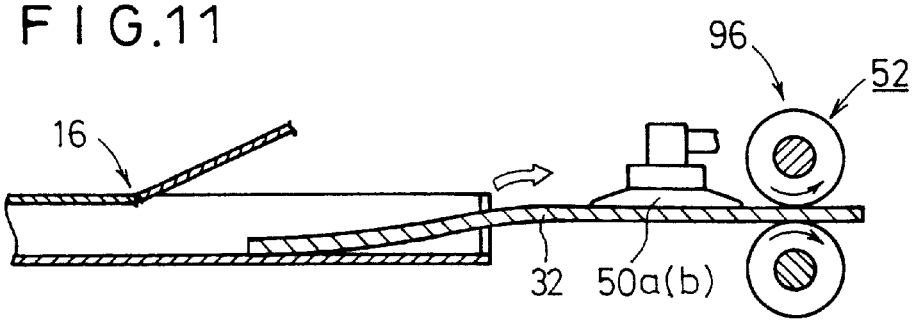
FIG. 11 is a cross-sectional view showing the suction cups as they feed the attracted stimulable phosphor sheet toward nip rollers in the sheet feeding mechanism shown in FIG. 2.

As the suction cups 50*a*, 50*b* are displaced away from the cassette 16, the stimulable phosphor sheet 32 attracted thereby has its leading end gripped by the nip rollers 96 which are being rotated in the directions indicated by the arrows in FIG. 11 at a predetermined speed by the second motor 102. Substantially at the same time that the leading end of the stimulable phosphor sheet 32 is gripped by the nip rollers 96, the suction cups 50*a*, 50*b* release the stimulable phosphor sheet 32. The stimulable phosphor sheet 32 then travels continuously from the nip rollers 96 through the nip rollers 98 to the nip rollers 100, and thereafter is delivered by the sheet delivery system 22 through the erasing section 24 to the reading section 26.

In the reading section 26, as shown in FIG. 1, the stimulable phosphor sheet 32 is delivered in the auxiliary scanning direction indicated by the arrow A by the auxiliary scanning system 38, and at the same time, the recording of the stimulable phosphor sheet 32 is scanned in the main scanning direction by the laser beam L from the optical system 40. Therefore, the radiation image information recorded on the stimulable phosphor sheet 32 is photoelectrically read by the light guiding system 42.

After the recorded radiation image information is read from the stimulable phosphor sheet 32 by the reading section 26, the stimulable phosphor sheet 32 is delivered back by the sheet delivery system 22. While the stimulable phosphor sheet 32 is being delivered upwardly along the vertical delivery path by the sheet delivery system 22, remaining radiation image information on the stimulable phosphor sheet 32 is erased by the erasing light sources 30 of the remaining section 24. Thereafter, the stimulable phosphor sheet 32 is sent back into the cassette 16 by the sheet feeding mechanism 10. When the cassette 16 is withdrawn from the cassette loading section 18, the lid 48 is closed onto the housing 44 by the lid opening/closing mechanism in the cassette loading section 18. The closed cassette 16 is now taken out of the image information reading apparatus 12.

Figure 9:
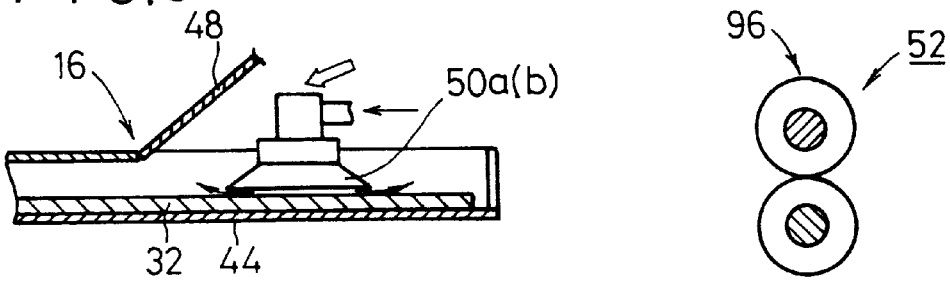
FIG. 9 is a cross-sectional view showing the suction cups as they have been moved and eject air in the sheet feeding mechanism shown in FIG. 2.

In the first embodiment, when the suction cups 50*a*, 50*b* are moved to the stimulable phosphor sheet 32 in the cassette 16, air is ejected from the suction cups 50*a*, 50*b* toward the surface to be attracted of the stimulable phosphor sheet 32 (see FIG. 9). Therefore, an air layer is developed between the attracting surfaces (skirts) of the suction cups 50*a*, 50*b* and the surface to be attracted of the stimulable phosphor sheet 32, allowing the suction cups 50*a*, 50*b* to move smoothly to a desired position on the surface to be attracted of the stimulable phosphor sheet 32 without being subject to much frictional resistance.

Consequently, the suction cups 50*a*, 50*b* can quickly move to an accurate position on the stimulable phosphor sheet 32, and hence can reliably attract the stimulable phosphor sheet 32. Since any undesirable frictional resistance between the suction cups 50*a*, 50*b* and the stimulable phosphor sheet 32 is essentially eliminated, the suction cups 50*a*, 50*b* are prevented from being deformed and hence from failing to attract the stimulable phosphor sheet 32, and the stimulable phosphor sheet 32 is prevented from being positionally displaced before being attracted by the suction cups 50*a*, 50*b*.

The piping system 58 has only the first and second solenoid-operated directional control valves 92*a*, 92*b*, each comprising a three-port valve, connected respectively to the inlet and outlet ports 56*a*, 56*b* of the vacuum pump 56. Accordingly, the piping system 58 is highly simple in structure and can be manufactured relatively inexpensively.

Because air is ejected from the suction cups 50*a*, 50*b* toward the surface to be attracted of the stimulable phosphor sheet 32, dust particles deposited on the stimulable phosphor sheet 32 can be blown away by the ejected air. The surface to be attracted of the stimulable phosphor sheet 32 is thus made clean and smooth, and can reliably be attracted by the suction cups 50*a*, 50*b*. In addition, when the piping system 58 is switched to develop a vacuum in the suction cups 50*a*, 50*b*, since no dust particles are present on the stimulable phosphor sheet 32, the piping system 58 does not draw undesirable dust particles, and hence is prevented from being clogged during operation.

Moreover, when the stimulable phosphor sheet 32 is transferred to the sheet delivering mechanism 52 after being attracted and removed from the cassette 16 by the suction cups 50*a*, 50*b*, the suction cups 50*a*, 50*b* can eject air to separate the stimulable phosphor sheet 32 reliably therefrom.

In the first embodiment, the suction cups 50*a*, 50*b* are arranged to move along the path which is inclined obliquely downwardly toward the surface to be attracted of the stimulable phosphor sheet 32 in the cassette 16. However, even if the suction cups 50*a*, 50*b* move vertically downwardly toward the stimulable phosphor sheet 32 in the cassette 16, the suction cups 50*a*, 50*b* are prevented from being unduly deformed because of air ejected therefrom.

The cassette loading section 18 for loading the cassette 16 which stores a single stimulable phosphor sheet 32 may be replaced with a magazine loading section for loading a magazine which stores a plurality of stimulable phosphor sheets or a plurality of photographic films.

Figure 12:
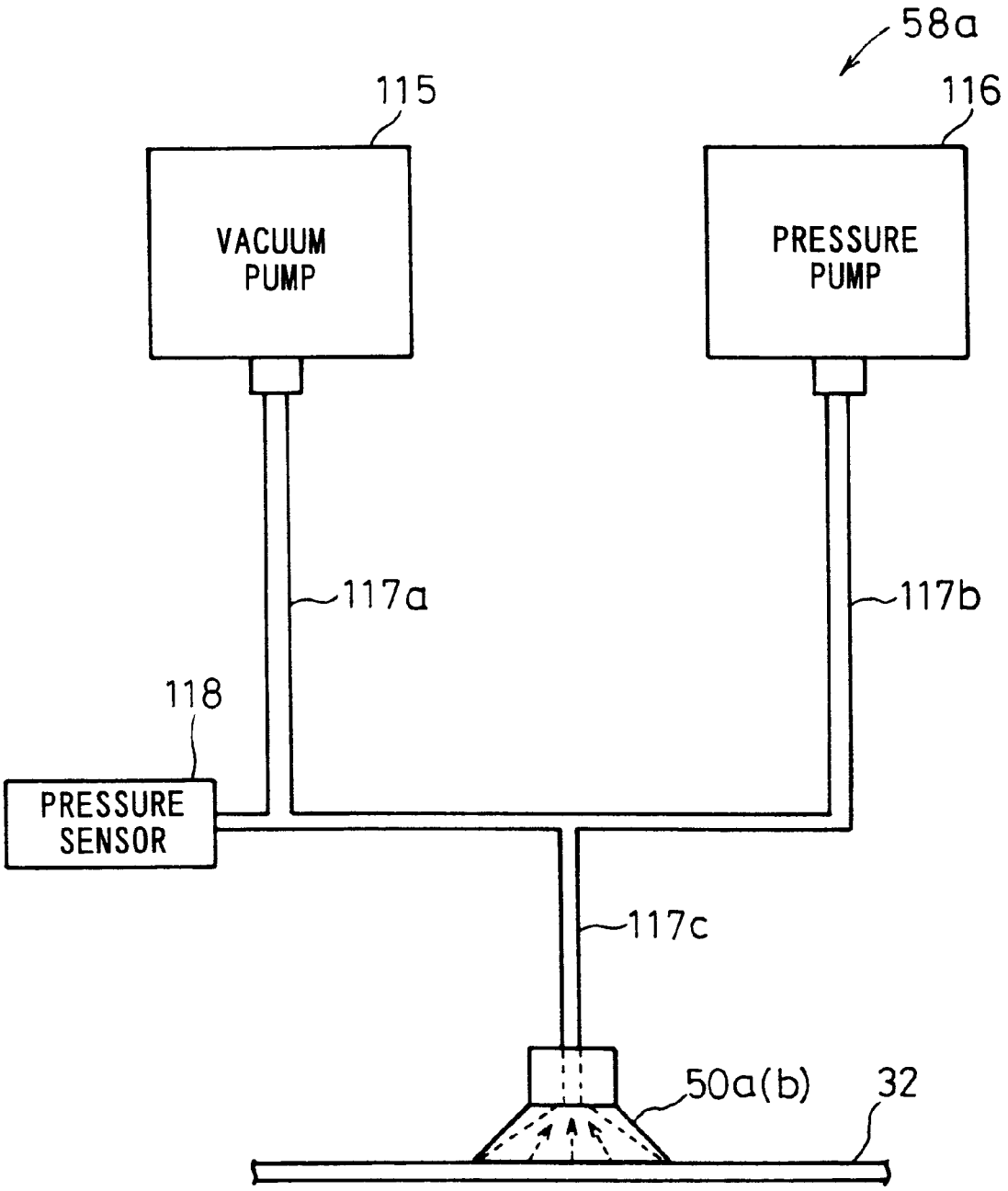
FIG. 12 is a schematic diagram of a piping system of the sheet feeding mechanism according to a second embodiment of the present invention.

FIG. 12 is a schematic diagram of a piping system 58*a* of the sheet feeding mechanism according to a second embodiment of the present invention. piping system 58*a* comprises a vacuum pump (vacuum source) 115, a first passage 117*a* communicating with the suction cups 50*a*, 50*b* and the vacuum pump 115, a pressure pump (pressurized air source) 116, a second passage 117*b* communicating with the suction cups 50*a*, 50*b* and the pressure pump 116. The first and second passages 117*a*, 117*b* are merged into a third passage 117*c* to communicate with the suction cups 50*a*, 50*b*. The first passage 117*a* or the second passage 117*b* is connected to a pressure sensor (pressure detecting means) 118. The vacuum pump 115 and the pressure pump 116 have a mechanism for preventing back flow of air in OFF-state.

In the second embodiment as constructed above, when the suction cups 50*a*, 50*b* are moved to the stimulable phosphor sheet 32, the pressure pump 116 is actuated (ON-state) for ejecting air toward the stimulable phosphor sheet 32.

Further, when the suction cups 50*a*, 50*b* are moved to a position where they will attract the stimulable phosphor sheet 32, the vacuum pump 115 is actuated (ON-state) and the pressure pump 116 is turned off (OFF-state) for attracting the stimulable phosphor sheet 32. Accordingly, the same effect as the one in the first embodiment is achieved.

Figure 13:
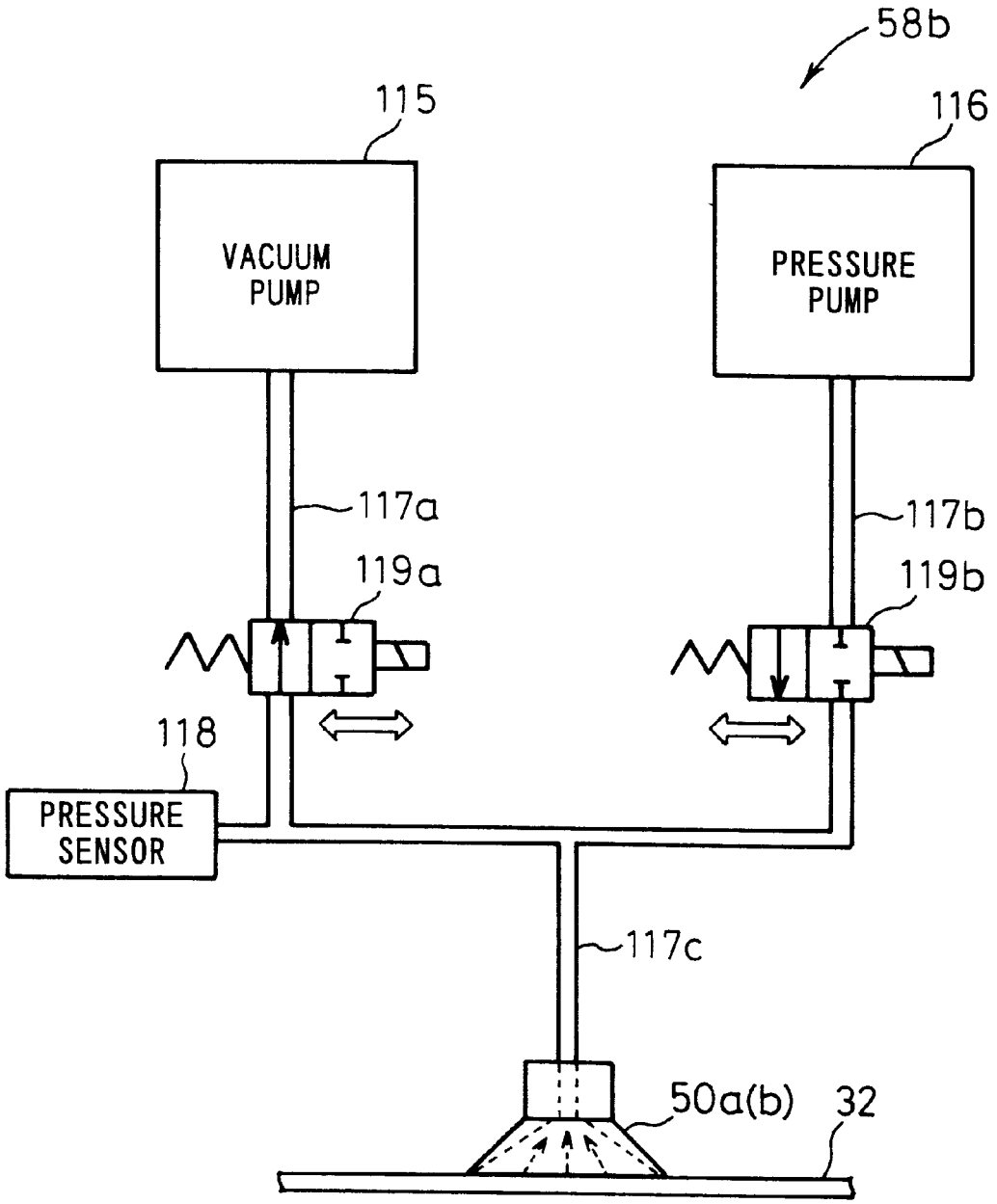
FIG. 13 is a schematic diagram of a piping system of the sheet feeding mechanism according to a third embodiment of the present invention.

FIG. 13 is a schematic diagram of a piping system 58*b* of the sheet feeding mechanism according to a third embodiment of the present invention. Those parts of the piping system 58*b* which are identical to those of the piping system 58*a* according to the second embodiment are denoted by identical reference characters, and will not be described in detail below.

In the piping system 58*b*, first and second opening and closing valves 119*a*, 119*b*, which are solenoid-operated valves, are connected to the first and the second passages 117*a*, 117*b*, respectively. As shown in FIG. 13, when the vacuum pump 115 is actuated (ON-state), the first opening and closing valve 119*a* is opened and the second opening and closing valve 119*b* is closed. Therefore, air is prevented from flowing back to a side of the pressure pump 116. Further, when the pressure pump 116 is actuated (ON-state), the first opening and closing valve 119*a* is closed and the second opening and closing valve 119*b* is opened.

Figure 14:
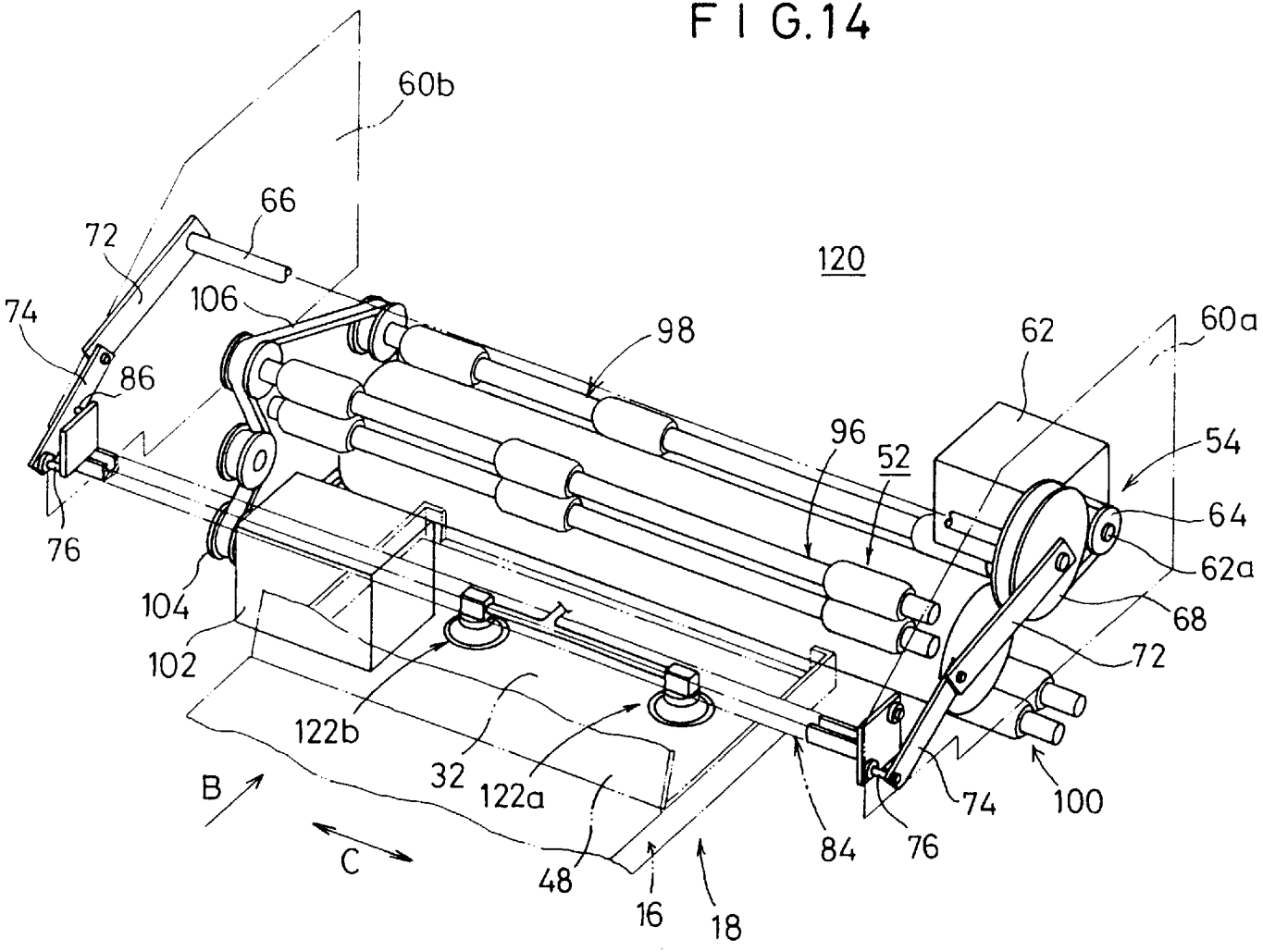
FIG. 14 is a perspective view of a sheet feeding mechanism according to a fourth embodiment of the present invention.

FIG. 14 shows in perspective a sheet feeding mechanism 120 according to a fourth embodiment of the present invention. Those parts of the sheet feeding mechanism 120 which are identical to those of the sheet feeding mechanism 10 according to the first embodiment are denoted by identical reference characters, and will not be described in detail below.

As shown in FIG. 14, the sheet feeding mechanism 120 has a pair of suction cups 122*a*, 122*b* movable into the cassette 16 in the cassette loading section 18 with the lid 48 being open, and a displacing mechanism 54 for displacing the suction cups 122*a*, 122*b* between the cassette 16 and a sheet delivering mechanism 52 and bringing the stimulable phosphor sheet 32 in the cassette 16 to the sheet delivering mechanism 52.

Figure 15:
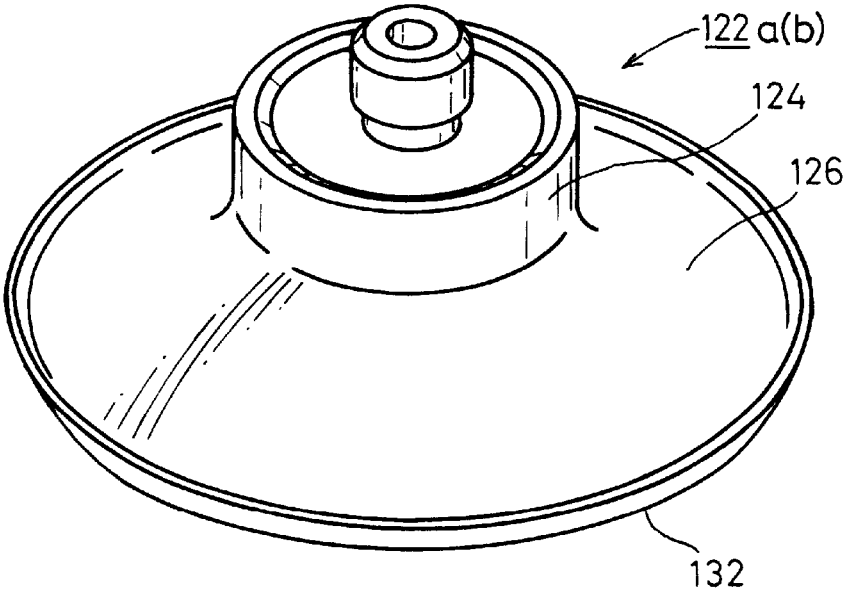
FIG. 15 is a perspective view of a suction cup of the sheet feeding mechanism according to the fourth embodiment.
Figure 16:
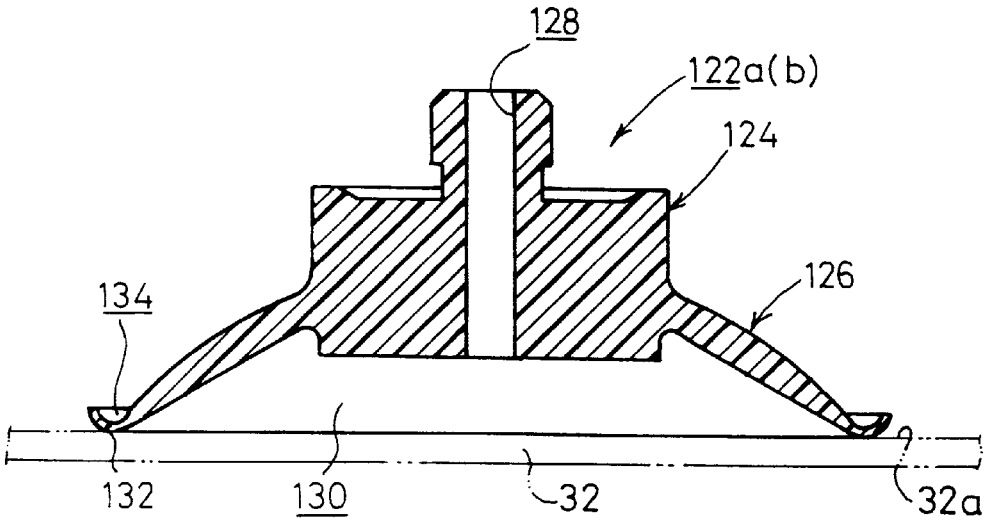
FIG. 16 is a cross-sectional view of the suction cup shown in FIG. 15.

Each of the suction cups 122*a*, 122*b* is made of an elastomeric material such as ethylene-propylene rubber (EPDM), butadiene acrylonitrile rubber (NBR), or the like. As shown in FIGS. 15 and 16, each of the suction cups 122*a*, 122*b* comprises a base 124 communicating with a vacuum source (not shown), and a conical skirt 126 integral with the base 124 for attracting a surface 32*a* of a stimulable phosphor sheet 32. The base 124 has a through hole 128 defined therein for connection to the vacuum source and communicating with a suction chamber 130 which is defined between the surface 32*a* of the stimulable phosphor sheet 32 and an inner surface of the skirt 126.

The skirt 126 has an annular convex lip 132 of arcuate cross section on its free end for contacting the surface 32*a* of the stimulable phosphor sheet 32. The skirt 126 is tapered from the base 124 toward the annular convex lip 132. The annular convex lip 132 is curved away from the surface 32*a* of the stimulable phosphor sheet 32. The free end of the skirt 126 also has an annular recess 134 defined therein and opening away from the annular convex lip 132.

Figure 17:
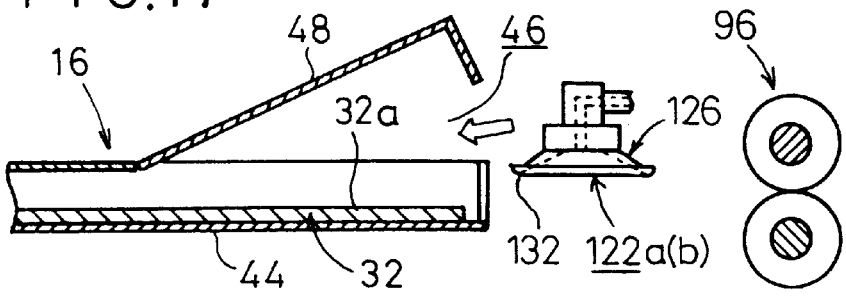
FIG. 17 is a cross-sectional view showing the suction cups as they move into a cassette in the sheet feeding mechanism shown in FIG. 14.

The sheet feeding mechanism 120 according to the fourth embodiment operates as follows: As shown in FIG. 17, the suction cups 122*a*, 122*b*.are moved by the displacing mechanism 54 along the path which is inclined obliquely downwardly toward the surface 32*a* to be attracted of the stimulable phosphor sheet 32 in the cassette 16.

Figure 18:
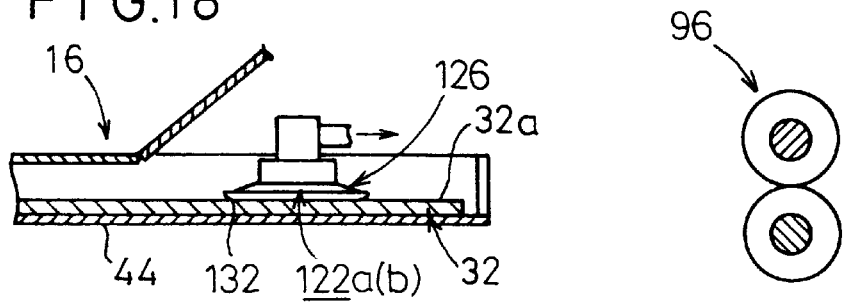
FIG. 18 is a cross-sectional view showing the suction cups as they have entered the cassette in the sheet feeding mechanism shown in FIG. 14.

Then, as shown in FIG. 18, with the suction cups 122*a*, 122*b* attracting the surface 32*a* of the stimulable phosphor sheet 32, the first motor 62 of the displacing mechanism 54 is reversed. The arms 72 are angularly moved to move the movable frames 84 and the suction cups 122*a*, 122*b* from the cassette 16 toward the sheet delivering mechanism 52. The stimulable phosphor sheet 32 attracted by the suction cups 122*a*, 122*b* is now taken out of the cassette 16 through the opening 46.

Figure 19:
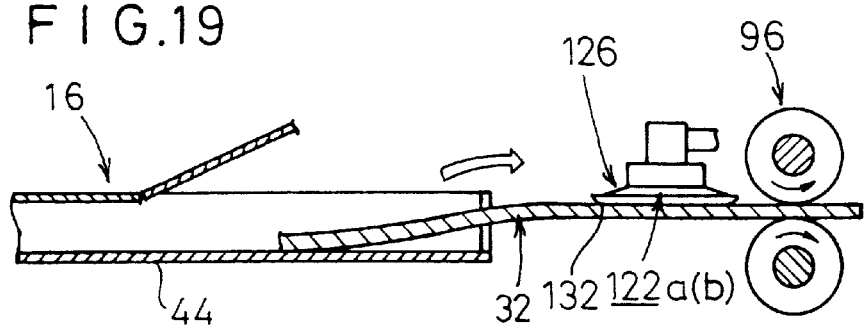
FIG. 19 is a cross-sectional view showing the suction cups as they insert an attracted stimulable phosphor sheet between nip rollers.

The leading end of the stimulable phosphor sheet 32 is then gripped by the rollers 96 of the sheet delivering mechanism 52. At this time, the nip rollers 96 are being rotated in the directions indicated by the arrows in FIG. 19 at a predetermined speed by the second motor 102. Substantially at the same time that the leading end of the stimulable phosphor sheet 32 is gripped by the nip rollers 96, the suction cups 122*a*, 122*b* release the stimulable phosphor sheet 32.

According to the fourth embodiment, as shown in FIGS. 15 and 16, the free end of the skirt 126 of each of the suction cups 122*a*, 122*b* has the annular convex lip 132 of arcuate cross section. Therefore, when the suction cups 122*a*, 122*b* move obliquely downwardly toward the surface 32*a* of the stimulable phosphor sheet 32 and then the skirt 126 slides on the surface 32*a* of the stimulable phosphor sheet 32, the free end of the skirt 126 is prevented from being rolled or deformed on the surface 32*a* by frictional engagement therewith because the lower curved surface of the annular convex lip 132 smoothly slides on the surface 32*a*.

Consequently, no gap is created between the free end of the skirt 126 and the surface 32*a*. The suction chamber 130 defined between the surface 32*a* and the skirt 126 is effectively evacuated by the vacuum source through the hole 128 for thereby firmly and reliably attracting the stimulable phosphor sheet 32.

Each of the suction cups 122*a*, 122*b* has the annular convex lip 132 on the free end of the skirt 126, which is curved away from the surface 32*a*. Since the suction cups 122*a*, 122*b* are relatively simple in structure, the sheet feeding mechanism 120 is also relatively simple in structure, and hence can be manufactured relatively inexpensively.

Figure 20:
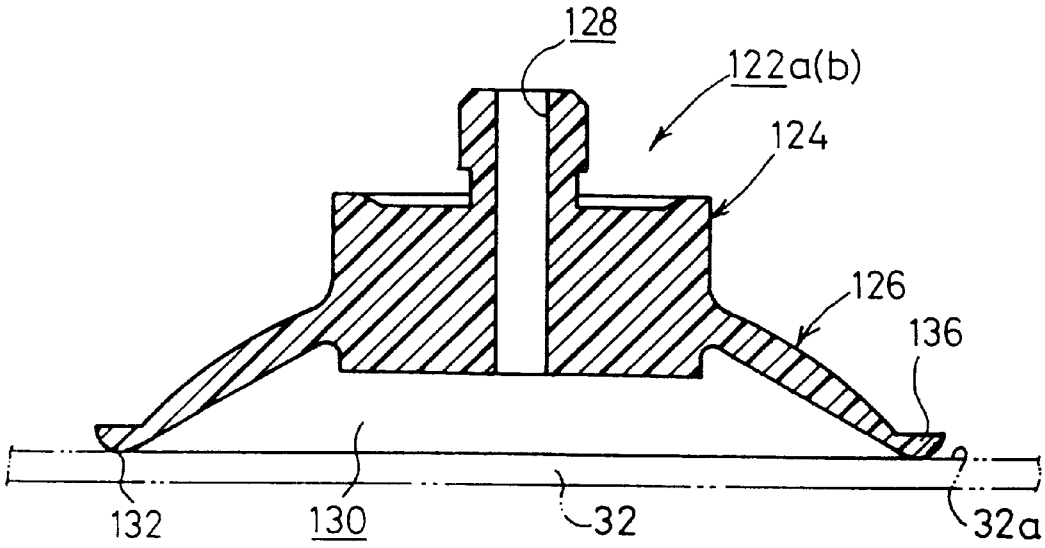
FIG. 20 is a cross-sectional view of a modified suction cup.
Figure 21:
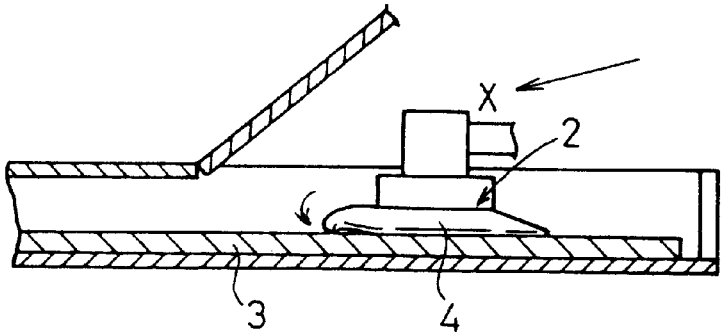
PRIOR ART FIG.21
FIG. 21 is a cross-sectional view showing the manner in which a conventional suction cup attracts a sheet in a cassette.

In the fourth embodiment, as shown in FIG. 16, the annular recess 134 is defined in the free end of the skirt 126 and open away from the annular convex lip 132. FIG. 20 shows a modified suction cup including a skirt 126 having a free end which has an annular convex lip 132 for contacting the surface 32*a* of the stimulable phosphor sheet 32 and an annular solid portion 136 facing away from the annular convex lip 132. The annular solid portion 136 is effective to reinforce the free end of the skirt 126.

The suction cups 50*a*, 50*b* in the sheet feeding mechanism 10 according to the first, second, and third embodiments may be replaced with the suction cups 122*a*, 122*b*.

The suction cups 122*a*, 122*b* thus incorporated in the sheet feeding mechanism 10 are capable of more smoothly and reliably attracting the stimulable phosphor sheet 32 and removing the stimulable phosphor sheet 32 from the cassette 16.

According to the present invention, as described above, since the suction cups are moved to a sheet removal position for removing a sheet from the cassette and eject air toward a surface to be attracted of the sheet, an air layer is developed between the attracting surfaces of the suction cups and the surface to be attracted of the sheet. Since any undesirable frictional resistance between the suction cups and the sheet is essentially eliminated, the suction cups are prevented from being deformed, and the sheet is prevented from being positionally displaced before being attracted by the suction cups. Thus, the suction cups are capable of smoothly and reliably attracting the sheet and removing the sheet from the cassette.

Furthermore, each of the suction cups has a skirt which has on its free end an annular convex lip of arcuate cross section for contacting the surface to be attracted of the sheet. Because the annular convex lip can smoothly slide on the surface to be attracted of the sheet, the free end of the skirt is prevented from being rolled or deformed on the surface to be attracted of the sheet by frictional engagement therewith. As a result, the suction cups are capable of smoothly and reliably attracting the sheet without fail. In addition, the sheet feeding mechanism can effectively be simplified in structure.

Although certain preferred embodiments of the present invention have been shown and described in detail, it should be understood that various changes and modifications may be made therein without departing from the scope of the appended claims.

What is claimed is:

1. A method of feeding a sheet, comprising the steps of:

placing at least one sheet in a sheet removal position;

moving a suction cup to said sheet removal position;

ejecting air from said suction cup toward a surface to be attracted to said sheet;

evacuating said suction cup to cause said suction cup to attract the surface to be attracted to said sheet; and moving said suction cup which has attracted said sheet away from said sheet removal position.

2. The method according to claim 1, further comprising the step of:

moving said suction cup to said sheet removal position along a path which is inclined obliquely downwardly toward the surface to be attracted of said sheet.

3. The method according to claim 1, further comprising the step of:

ejecting air from said suction cup when said sheet attracted by said suction cup is transferred toward a sheet delivering mechanism.

4. An apparatus for feeding a sheet, comprising:

a suction cup movable into and out of a receptacle which stores at least one sheet and is open in a loading section;

a displacing mechanism for displacing said suction cup between a position in said receptacle and a sheet delivering mechanism to cause said suction cup to transfer said sheet from said receptacle to said sheet delivering mechanism; and a piping system for attracting said sheet with said suction cup, and for ejecting air from said suction cup toward a surface to be attracted to said sheet when said suction cup is moved into said receptacle.

5. The apparatus according to claim 4, wherein said piping system comprises:

a vacuum source;

a circulation passage communicating with said suction cup and an inlet port and an outlet port of said vacuum source; and a pair of directional control valves connected to said circulation passage for selectively connecting said suction cup to said inlet port of the vacuum source to cause said suction cup to attract the sheet, and connecting said suction cup to said outlet port of the vacuum source to eject air from said suction cup toward the surface to be attracted to said sheet.

6. The apparatus according to claim 5, wherein said directional control valves comprise, respectively, a first solenoid-operated three-port valve connected to said inlet port of the vacuum source and a second solenoid-operated three-port valve connected to said outlet port of the vacuum source.

7. The apparatus according to claim 5, wherein said piping system further comprises:

pressure detecting means connected to said circulation passage between said suction cup and said inlet port of the vacuum source.

8. The apparatus according to claim 4, wherein said piping system comprises:

a vacuum source;

a first passage communicating with said suction cup and said vacuum source;

a pressurized air source; and a second passage communicating with said suction cup and said pressurized air source.

9. The apparatus according to claim 8, wherein said first passage or said second passage is connected to a pressure detecting means.

10. The apparatus according to claim 8, wherein first and second opening and closing valves are connected to said first and said second passages, respectively.

11. The apparatus according to claim 9, wherein first and second opening and closing valves are connected to said first and said second passages, respectively.

12. The apparatus according to claim 4, wherein said displacing mechanism comprises guiding means for moving said suction cup along a path which is inclined obliquely downwardly toward the surface to be attracted of said sheet in said receptacle.

13. The apparatus according to claim 4, wherein said receptacle comprises a cassette for storing said sheet.

14. The apparatus according to claim 4, wherein said suction cup has a skirt for attracting said sheet, said skirt having on a free end thereof an annular convex lip of arcuate cross section for contacting the surface to be attracted to said sheet.

15. The apparatus according to claim 14, wherein said annular convex lip is curved away from the surface to be attracted to said sheet.

16. An apparatus for feeding a sheet, comprising:

a suction cup movable into and out of a receptacle which stores at least one sheet and is open in a loading section; and a displacing mechanism for displacing said suction cup between a position in said receptacle and a sheet delivering mechanism to cause said suction cup to transfer said sheet from said receptacle to said sheet delivering mechanism;

said suction cup having a skirt for attracting said sheet, said skirt having on a free end thereof an annular convex lip of arcuate cross section having a bottom portion for contacting a surface of said sheet, said annular lip being curved away from the surface to be contacted, so as to form an annular recess which faces away from the surface to be contacted.

17. The apparatus according to claim 16, wherein said skirt has on the free end thereof an annular solid portion facing away from said annular convex lip.

18. The apparatus according to claim 16, wherein said displacing mechanism comprises guiding means for moving said suction cup along a path which is inclined obliquely downwardly toward the surface to be attracted the said sheet in said receptacle.

19. The apparatus according to claim 16, wherein only said annular convex lip of arcuate cross section of the suction cup is in contact with the stimulable phosphor sheet when the suction cup is moved on the surface to be attracted to the stimulable phosphor sheet.

20. The apparatus according to claim 16, wherein a main portion of said skirt, which extends to said annular recess, is smooth.

* * * * *